US011434441B2

(12) United States Patent
Burger

(10) Patent No.: US 11,434,441 B2
(45) Date of Patent: Sep. 6, 2022

(54) BLENDED GASOLINE COMPOSITION

(71) Applicant: John Burger, Virginia Beach, VA (US)

(72) Inventor: John Burger, Virginia Beach, VA (US)

( * ) Notice: Subject to any disclaimer, the term of this patent is extended or adjusted under 35 U.S.C. 154(b) by 0 days.

(21) Appl. No.: 17/314,579

(22) Filed: May 7, 2021

(65) Prior Publication Data

US 2021/0261873 A1 Aug. 26, 2021

(51) Int. Cl.

| | |
|---|---|
| ***C10L 1/04*** | (2006.01) |
| ***C10L 1/16*** | (2006.01) |
| ***C10L 1/182*** | (2006.01) |
| ***C10L 1/223*** | (2006.01) |

(52) U.S. Cl.

CPC ..... *C10L 1/1824* (2013.01); *C10L 1/1608* (2013.01); *C10L 1/1616* (2013.01); *C10L 1/223* (2013.01); *C10L 2200/0259* (2013.01); *C10L 2200/0415* (2013.01); *C10L 2200/0453* (2013.01); *C10L 2230/22* (2013.01)

(58) Field of Classification Search

CPC ..... C10L 10/10; C10L 1/023; C10L 1/1608; C10L 1/1616; C10L 1/1824; C10L 1/223; C10L 2200/0259; C10L 2200/0415; C10L 2200/0453; C10L 2230/22; C10L 2270/023

See application file for complete search history.

(56) References Cited

U.S. PATENT DOCUMENTS

| | | | |
|---|---|---|---|
| 5,288,393 | A | 2/1994 | Jessup et al. |
| 5,851,241 | A | 12/1998 | Studzinski et al. |
| 7,462,207 | B2 | 12/2008 | Clark |
| 7,597,724 | B2 | 10/2009 | Cracknell |
| 8,232,437 | B2 | 7/2012 | Clark et al. |
| 8,715,373 | B2 | 5/2014 | Aradi et al. |
| 9,885,000 | B2 | 2/2018 | Nousiainen et al. |
| 10,450,526 | B2 | 10/2019 | D'Acosta et al. |
| 10,808,195 | B2 | 10/2020 | Abdul-Manan et al. |
| 10,883,061 | B2 | 1/2021 | Goldsmith et al. |
| 10,894,927 | B2 | 1/2021 | Karvo et al. |
| 2005/0044778 | A1 | 3/2005 | Orr |
| 2014/0128644 | A1* | 5/2014 | Braly ..... C10L 10/10 585/14 |
| 2016/0010018 | A1 | 1/2016 | D'Acosta et al. |
| 2018/0355265 | A1 | 12/2018 | Price et al. |
| 2020/0290947 | A1 | 9/2020 | Gerdinand et al. |

FOREIGN PATENT DOCUMENTS

| | | |
|---|---|---|
| EP | 3202875 | 9/2017 |
| RU | 2554076 | 6/2015 |
| WO | 2018215881 | 11/2018 |
| WO | 2020201964 | 10/2020 |

OTHER PUBLICATIONS

Al-Mashhadani et al. "Improvement of Gasoline Octane Number by Using Organic Compounds", vol. 11 (2) (2014) (Year: 2014).*

Karavalakis, Georgios, et al., Evaluating the Effects of Aromatics Content in Gasoline on Gaseous and Particulate Matter Emissions from SI-PFI and SIDI Vehicles, Environmental Science & Technology, DOI: 10.1021/es5061726, May 4, 2015, 49, pp. 7021-7031.

Segal, Scott H., Fuel for Thought: Clean Gasoline and Dirty Patents, American University Law Review, Article 2, vol. 51, Issue 1, Oct. 2001, pp. 49-89.

Cooper, Geoff, Ethanol and the Economics of Octane, Renewable Fuels Association, Oct. 20, 2017, pp. 1-26.

Sjoberg, Magnus, et al., Effects of Gasoline Composition and Octane Sensitivity on the Response of DISI Engine Knock to Variations of Fuel-Air Equivalence Ratio, Japan Society of Mechanical Engineers, 2017, pp. 1-10.

Renewable Fuels Association, Fuel Ethanol—Industry Guidelines, Specifications and Procedures, Dec. 2010, pp. 1-41.

Rankovic, Nikola, et al., Knock management for dual fuel SI engines: RON evolution when mixing low RON base fuels with octane boosters, 2015, pp. 1-17.

Al-Mashhadani, Nibal H., et al., "Improvement of Gasoline Octane Number by Using Organic Compounds", vol. 11 (2) 2014, p. 506, right col., para 8, p. 505, right col., para 2, Table 2-3, p. 503, left col., para 1, p. 502, right col., para 1—p. 502, left col. para 1, p. 1-7.

McCormick, Robert L., et al., "Selection Criteria and Screening of Potential Biomass-Derived Streams as Fuel Blendstocks for Advanced Spark-Ignition Engines", vol. 10, No. 2, Jun. 2017, pp. 1-19.

Viayna, Antonio, et al., "Holistic Approach to Anti-Knock Agents: A High-Throughput Screening of Aniline-Like Compounds", 2021, p. 1-9.

Leuenberger, Ernest, et al., "Process for Producing Gasoline Blending Components From Jet Range and Heavier Aromatics", U.S. Statutory Invention Registration No. H1723, Apr. 7, 1998, p. 1-10.

International Search Report and Written Opinion mailed in corresponding PCT Application No. PCT/US2021/045749 dated Dec. 7, 2021, p. 1-11.

* cited by examiner

*Primary Examiner* — Ellen M McAvoy
*Assistant Examiner* — Chantel L Graham
(74) *Attorney, Agent, or Firm* — McAfee & Taft, A Professional Corporation

(57) ABSTRACT

Disclosed is a blended gasoline composition having an AKI of 87. The formulation of the blended gasoline composition leads to a reduction in carbon dioxide emission. The blended gasoline composition contains a reduced concentration of olefins and non-amine aromatics.

41 Claims, No Drawings

BLENDED GASOLINE COMPOSITION

BACKGROUND

Formulations of commercial motor gasoline that are designed to reduce carbon dioxide emission are highly desired around the world. To provide the necessary octane levels for regular and premium grade gasoline, current commercially available automobile motor gasoline formulations include manufactured aromatic hydrocarbons. Aromatic hydrocarbons are manufactured from hydrogen rich paraffins and naphthenic molecules found in naphtha by a catalytic reforming process. The catalytic reforming process yields a product commonly referred to as "reformate" which has a significantly higher anti-knock index (AKI) value (R+M/2). Use of catalytic reformers contribute to carbon dioxide emission in four fundamental ways. First, it raises the carbon intensity of the fuel by removing hydrogen from the paraffins and naphthenic molecules to produce the aromatics. Second, it lowers the energy content per lb. of fuel since aromatics have lower energy content; and, thus increases the amount of fuel burned for the same energy released. Third, hydrogen rich fuel gas, a by-product, is produced in the process by cracking reactions. This results in an unwanted yield loss, raising the feedstock volume of naphtha required to produce the desired amount of reformate and subsequently increasing fossil fuel usage. And fourth, the reformation process requires high temperatures which in turn increases the release of carbon dioxide.

Therefore, the provision of a blended gasoline composition prepared by processes which lower carbon dioxide emission during the manufacturing process and provide lower carbon dioxide emission upon combustion would significantly improve the environment.

SUMMARY

Disclosed herein is a blended gasoline composition formulated to reduce emissions of carbon. The blended gasoline composition comprises:

- an aromatic amine selected from the group consisting of m-toluidine, p-toluidine, o-toluidine and aniline as well as mixtures of the identified compounds in concentrations ranging from about 0.1% to about 5% by volume;
- ethanol in concentrations up to about 20%;
- non-amine aromatic hydrocarbons in concentrations up to about 15%;
- olefins in concentrations up to about 8%;
- paraffins in concentrations up to about 86%.

Also disclosed herein is a blended gasoline composition formulated to reduce emissions of carbon. The blended gasoline composition comprises:

- an aromatic amine selected from the group consisting of m-toluidine, p-toluidine, o-toluidine and aniline as well as mixtures of the identified compounds in concentrations ranging from about 0.1% to about 5% by volume;
- ethanol in concentrations up to about 20%; and
- paraffins in concentrations up to about 86%.

The disclosed blended gasoline composition is substantially free of aromatic compounds.

DETAILED DESCRIPTION

The present disclosure may be understood more readily by reference to these detailed descriptions. In addition, numerous specific details are set forth in order to provide a thorough understanding of the various embodiments described herein. However, it will be understood by those of ordinary skill in the art that the embodiments described herein can be practiced without these specific details. The description is not to be considered as limiting the scope of the embodiments described herein. Also, it is to be understood that the phraseology and terminology employed herein is for the purpose of description and should not be regarded as limiting except where indicated as such.

Throughout this disclosure, the terms "about", "approximate", and variations thereof, are used to indicate that a value includes the inherent variation or error for the device, system, the method being employed to determine the value, or the variation that exists among the study subjects. Unless otherwise stated herein all formulations are provided as a percent by volume basis.

The following disclosure provides a blended gasoline composition suitable for use in over the road vehicles and off road vehicles. The disclosed blended gasoline composition is compatible with all current versions of gasoline intended for use in over the road vehicles and off road vehicles. Additionally, the disclosed blended gasoline composition can be distributed without significant modification to the current fuel distribution system. As will be described in more detail below, the disclosed blended gasoline composition produces significantly lower carbon dioxide emissions than currently available versions of gasoline. As a further benefit, the disclosed blended gasoline composition, when compared to currently used gasoline compositions, has energy values equal to or better than the current gasoline compositions due to their higher paraffinic content.

The disclosed blended gasoline composition achieves the reduction in carbon dioxide emissions by substantially eliminating aromatic compounds from the formulation of the blended gasoline composition. The target maximum concentration of aromatic compositions within the blended gasoline composition is less than 15% by volume, not including aromatic amines. More typically, the blended gasoline composition will have less than 10% aromatic content, not including aromatic amines. Even more typically, the blended gasoline composition will have less than 5% aromatic content, not including aromatic amines. Preferably, the blended gasoline composition will have 0% aromatic content, not including aromatic amines.

The disclosed blended gasoline composition also reduces emissions by limiting the amount of olefins, also known as alkenes, in the composition. Typically, the blended gasoline composition will have less than 10% by volume olefins. More typically, the blended gasoline composition will have less than 8% olefin content. More commonly, the blended gasoline composition will have less than 5% olefin content. Preferably, the blended gasoline composition will have 0% olefin content.

The disclosed blended gasoline composition includes a base fuel blend of hydrocarbons as commonly produced by most refineries. The base fuel blend contains hydrocarbons having chain lengths as commonly produced by refinery units such as hydrocrackers, isomerization units, alkylation units, hydrodesulfurization units, and optionally fluid catalytic cracker units and optionally reformers. Thus, products commonly known in the industry as alkylate, reformate, FCCU gasoline, isomerate and naphtha may be included in the base fuel blend. Such units typically produce hydrocarbons having chains lengths of about four carbon atoms to about 12 carbon atoms (C4 to C12). More typically, the base fuel blend will have from five carbon atoms to 12 carbon atoms (C5 to C12). Such hydrocarbons include, but are not limited to, paraffins, olefins, naphthene and aromatic hydrocarbons. As discussed above, the olefin and aromatic constituents are preferably of limited concentrations or eliminated. Typically, the base fuel blend will make up about 70% to about 90% by volume of the total blended gasoline composition.

One suitable base fuel blend can be obtained from renewable diesel and jet fuel manufacturing plants. Such base fuel blend will be characterized as having an anti-knock index (AKI=RON+MON/2) between about 50 and about 60, typically 55, where RON is research octane number and MON is motor octane number. Additionally, the following blending strategy is suitable for use with CBOB, RBOB and CARBOB base fuel blends once the aromatic amine has been added. The base fuel blend will have a boiling point in the range of 130° C. to 180° C. These base blending materials are known to those skilled in the art. CBOB stands for conventional blend stock for oxygenated blending. RBOB stands for reformulated blend stock for oxygenated blending. CARBOB stands for California reformulated blend stock for oxygenate blending.

Finally, by eliminating or substantially reducing the content of olefins and aromatics in the base fuel blend, the base fuel blend will have a PONA distribution that is different from current base fuels. As known to those skilled in the art, the ratio of paraffins, olefins, naphthene and aromatics is known as the fuels PONA. Typical base fuels have PONA's as follows:

paraffins: 25-50% by volume;
olefins: 0-10% by volume;
naphthenes: 5-10% by volume;
aromatics: 20-35% by volume.

However, the base fuel blend used in the present blended gasoline composition has a distinctly different PONA distribution as follows:

paraffins: 70-90% by volume;
olefins: 0-8% by volume;
naphthenes: 0-10% by volume;
aromatics: 0-15% by volume.

Additionally, current gasoline compositions frequently add ethanol to the base fuel in order to achieve the desired final AKI value. Current fuels utilize 0-10% by volume ethanol in the final blend. In contrast, the blended gasoline composition of the present invention utilizes from about 10% to about 20% by volume ethanol in the final blend.

Thus, by increasing the ethanol portion of the final blend, the blended gasoline composition further reduces the release of non-renewable carbon into the atmosphere. Additionally, of the PONA material, paraffins have the highest energy content per pound. Thus, maximizing the paraffins in the blended gasoline composition has the effect of decreasing the amount of fuel required to produce the same energy release as currently available gasolines. Further, removal of the aromatics and olefin content and increasing the paraffin content advantageously raises the hydrogen to carbon ratio of the blended gasoline composition while also taking advantage of the octane blending synergy of paraffins and ethanol. Further, reducing the aromatics and olefins in the base fuel, reduces the octane suppression factor aromatics and olefins have on ethanol. Likewise, reducing the aromatics in the base fuel reduces the negative octane blending factor exhibited between aromatics and paraffins. Data concerning the release of atmospheric carbon dioxide is provided in Table 4 below. The focus of Table 4 is on the reduction of the release of carbon dioxide to the atmosphere.

To provide a blended gasoline composition having the necessary octane value for over the road and off road use, the blended gasoline composition also includes between about 10% and about 20% ethanol. Typically, the blended gasoline composition contains between about 10% and 15% ethanol. Additionally, the blended gasoline composition contains an octane booster in the form of an aromatic amine. Suitable aromatic amines included, but are not limited to: aniline, m-toluidine, o-toluidine, p-toluidine and mixtures thereof. Typically, the blended gasoline composition contains up to 5% by volume of the octane booster. More commonly, the blended gasoline composition contains up to 4% by volume of the octane booster. Typically, the blended gasoline composition contains about 3% by volume of the octane booster. More typically the blended gasoline composition contains about 2% by volume of the octane booster. In most instances, the octane booster is m-toluidine at a concentration of about 1% to about 4% by volume.

In preparation of final gasoline compositions, refineries may blend several feed streams together. As known to those skilled in the art, true octane numbers do not blend linearly. Thus, one cannot simply blend a 50:50 mixture of two components and expect to always obtain an octane value equal to the volumetric average of the octane values of each component. Although some octane boosters have a generally known value when combined with current base fuel blends the octane value of boosters may vary depending on the composition of the selected base fuel blend. Typically, the final octane value of the resulting blend will be determined by conventional laboratory testing methods.

For example, a blend of 97% by volume high paraffinic naphtha and 3% by volume m-toluidine was subjected to octane testing. The naphtha had a lab measured RON octane number of 55. The blend of naphtha with m-toluidine had a lab measured octane number of RON 73.3. Using the following formula, one can determine the calculated octane blending value of an octane booster:

$$[(\%\ \text{Fuel}\ A)(\text{Octane of Fuel}\ A)]+[(\%\ \text{Fuel}\ B)(\text{Octane of Fuel}\ B)]=\text{Octane of Mixture}$$

Thus, to determine the octane blending value of m-toluidine:

$$(0.97\ \text{naphtha})(55)+(0.03\ m\text{-toluidine})(X)=73.3\ \text{laboratory tested octane number}$$

Solving for X, 665 is the blended octane value for m-toluidine. This blended octane value for m-toluidine is unique and previously unknown to those skilled in the art as no other octane booster is known to have a blended octane value greater than 250. The blended octane value of aromatic amines is influenced by the composition of the base gasoline. For instance, olefins and non-amine aromatics in the gasoline will depress the blended octane value of m-toluidine to as low as 300 in the disclosed blended gasoline composition.

By way of another example, in most instances the ethanol component will be added following the addition of the aromatic amine. Using the foregoing example of 97% by volume naphtha and 3% by volume m-toluidine, the fuel had an octane value of RON 73.3. In this example, 15% ethanol was added by volume to the fuel having the RON of 73.3 to increase the octane value to a lab tested RON of 84.4. Thus, applying the above formula:

$$(0.85\ \text{naphtha}/m\text{-toluidine})(73.3)+(0.15\ \text{ethanol})(X)=84.4\ \text{lab tested octane number}$$

Solving for X, 147.3 is the blended octane value for ethanol in this blended fuel. In contrast, pipelines require gasoline producers to use ethanol octane blending values of only 115 in their current gasolines CBOB, RBOB and CARBOB. Thus, the disclosed formulation realizes a significant increase in the octane blending value of ethanol. As with the aromatic amines, the presence of olefins and non-amine aromatics will depress the blended octane value of ethanol to as low as 130 in the disclosed blended gasoline composition.

In the production of the disclosed blended gasoline composition, the sequence of blending will likely be the initial formulation of a base fuel followed by the addition of an aromatic amine. The aromatic amine will likely be added at the refinery to create the CBOB, RBOB and CARBOB base blends. Subsequently, ethanol will be added at an appropriate point in the distribution system to achieve the final desired AKI value.

For clarity, the blended gasoline composition may have the following components:

- an aromatic amine selected from the group consisting of m-toluidine, p-toluidine, o-toluidine and aniline as well as mixtures of the identified compounds in concentrations ranging from 0.1% to 5% by volume;
- ethanol in concentrations up to 20%;
- other aromatic hydrocarbons in concentrations up to 15%;
- olefins in concentrations up to 8%;
- CBOB, RBOB or CARBOB type refinery product in concentrations up to 90% provided that the CBOB, RBOB or CARBOB material meets the specifications for aromatics and olefins as defined above.

A desired formulation will substantially lower or eliminate aromatic and olefin content providing a blended gasoline composition having the following components:

- an aromatic amine selected from the group consisting of m-toluidine, p-toluidine, o-toluidine and aniline as well as mixtures of the identified compounds in concentrations ranging from 0.1% to 5% by volume;
- ethanol in concentrations between 10% and 20%;
- other aromatic hydrocarbons in concentrations between 0% and 10%;
- olefins in concentrations between 0% and 5%;
- CBOB, RBOB or CARBOB type refinery product in concentrations up to 86% provided that the CBOB, RBOB or CARBOB material meets the specifications for aromatics and olefins as defined above.

A particularly desired formulation will eliminate aromatic and olefin content providing a blended gasoline composition having the following components:

- an aromatic amine selected from the group consisting of m-toluidine, p-toluidine, o-toluidine and aniline as well as mixtures of the identified compounds in concentrations ranging from 0.1% to 5% by volume;
- ethanol in concentrations between 10% and 20%;
- CBOB, RBOB or CARBOB type refinery product in concentrations up to 86% provided that the CBOB, RBOB or CARBOB material meets the specifications for aromatics and olefins as defined above.

In most instances, the blended gasoline composition will contain 2%-4% m-toluidine and ethanol at concentrations between 10% and 15% while being free of other aromatic compounds and free of olefins. Table 1 below compares the non-amine aromatic content of a commonly available winter gasoline formulation to the non-amine aromatic content of the disclosed blended gasoline composition. Table 1 also demonstrates the reduction of non-amine aromatic content when the disclosed blended gasoline composition is combined in a 50:50 mixture with the same winter gasoline formulation. Thus Table 1 also demonstrates that the disclosed blended gasoline composition is miscible with currently available gasolines and the corresponding mixture of currently available winter or summer gasoline can be blended with the disclosed blended gasoline composition for distribution as a final gasoline composition for use by consumers.

TABLE 1

Aromatic Content

| | | Winter Gasoline | BGC | Miscibility Test Formulation 50% volume BGC and 50% volume Winter Gasoline |
|---|---|---|---|---|
| Benzene | vol % | 0.39 | 0 | 0.20 |
| Toluene | vol % | 4.00 | 0 | 2.00 |
| Ethyl Benzene | vol % | 0.88 | 0 | 0.44 |
| meta-Xylene | vol % | 2.62 | 0 | 1.31 |
| para-Xylene | vol % | 1.01 | 0 | 0.51 |
| ortho-Xylene | vol % | 1.39 | 0 | 0.70 |
| isopropyl Benzene | vol % | 0.12 | 0 | 0.06 |
| n-Propyl Benzene | vol % | 0.28 | 0 | 0.14 |
| meta-Ethyltoluene | vol % | 0.94 | 0 | 0.47 |
| para-Ethyltoluene | vol % | 0.42 | 0 | 0.21 |
| 1,2,5 Trimethyl-benzene | vol % | 0.43 | 0 | 0.22 |
| ortho-Ethyltoluene | vol % | 0.35 | 0 | 0.18 |
| 1,2,4 Trimethylbenzene | vol % | 1.69 | 0 | 0.85 |
| 1,2,3 Triethylbenzene | vol % | 0.38 | 0 | 0.19 |
| Indane | vol % | 0.12 | 0 | 0.06 |
| 4-methyl Indane | vol % | 0.05 | 0 | 0.03 |
| 5-methyl Indane | vol % | 0.07 | 0 | 0.04 |
| Naphthalene | vol % | 0.09 | 0 | 0.05 |
| 2-methyl Naphthalene | vol % | 0.05 | 0 | 0.03 |
| 1-methyl Naphthalene | vol % | 0.03 | 0 | 0.02 |
| C10 Aromatics | vol % | 1.83 | 0 | 0.92 |
| C11 Aromatics | vol % | 0.05 | 0 | 0.03 |
| Dimethyl Indanes | vol % | 0.07 | 0 | 0.04 |
| Total non-amine Aromatic | vol % | 17.26 | 0.00 | 8.63 |

As reflected in Table 2 below, the blended gasoline composition is characterized as having an AKI of at least 87. While an AKI of 87 is the minimum for the blended gasoline composition, manipulation of the base fuel blend, the octane booster and ethanol content may provide higher AKI values up to about 100 when blending 20% ethanol, 5% m-toluidine and 75% CBOB. Additionally, Table 2 reflects the ability of the blended gasoline composition to satisfy the API specific gravity and RVP values for winter and summer blends.

TABLE 2

Lab Data Summary

| | | Winter Gasoline 87E10 Purchased Gasoline | Blended Gasoline Composition (BGC) Gasoline | Miscibility Test 50% Vol Winter Baseline 50% Vol BGC Gasoline |
|---|---|---|---|---|
| Gravity, API ASTM D-4052 | | 63.5 | 70 | |
| Specific Gravity | | 0.726 | 0.702 | 0.714 |
| Oxygenates | | 10% | 15% | 12.5% |
| Distillation ASTM D-86 | IBP | 77.3 | 82.2 | 79.75 |
| | 10 | 106.5 | 115.7 | 111.1 |

TABLE 2-continued

| Lab Data Summary | | | | |
|---|---|---|---|---|
| | | Winter Gasoline 87E10 Purchased Gasoline | Blended Gasoline Composition (BGC) Gasoline | Miscibility Test 50% Vol Winter Baseline 50% Vol BGC Gasoline |
| | 50 | 152.8 | 151.3 | 152.05 |
| | 90 | 311.1 | 244.8 | 277.95 |
| | FBP | 392.7 | 390.2 | 391.45 |
| Octane (AKI) R + M/2 | | 87.45* | 86.8* | 87.35* |
| Research Octane Number ASTM D-2699 | | 91.1 | 88.5 | 90 |
| Motor Octane Number ASTM D-2700 | | 83.8 | 85.1 | 84.7 |
| RVP (psi) ASTM D-5191 | | 12.87 | 12.78 | 12.83 |
| Aromatics - vol % ASTM D-5769 | | 17.26 | 0 | 8.63 |

*Lab test result - reflects that blending of the blending gasoline composition with conventional gasoline does not negatively impact the AKI value.

TABLE 3

| Heat of Combustion and Carbon/Hydrogen/Nitrogen/Oxygen values | | | | |
|---|---|---|---|---|
| Heat of Combustion BTU/lb per ASTM D-240 | | Winter Gasoline | Summer Gasoline | Blended Gasoline Composition |
| | Gross | 19242 | 18547 | 19050 |
| | Net | 17895 | | 17718 |
| Carbon/Hydrogen/Nitrogen weight % per ASTM D-5291 | | | | |
| | Carbon wt % | 82.02 | 83.16 | 78.21 |
| | Hydrogen wt % | 14.20 | 13.18 | 15.18 |
| | Nitrogen wt % | 0.00 | 0.00 | 0.75 |
| | Oxygen wt % | 3.78 | 3.65 | 5.86 |
| m-Toluidine, Vol % | | 0.0% | 0.0% | 4.0% |

A further characteristic of the disclosed blended gasoline composition is the ability of this composition to safely blend with current gasoline stocks.

Table 4, provided below, demonstrates the environmental improvements provided by use of the blended gasoline composition in replace of current winter and summer gasoline blends of available gasoline. The table provides data based on an annual gasoline consumption (2019) of 150 billion gallons per year. In the United States, gasoline is typically sold in Winter and Summer gasolines. Table 4 compares the combined total for the assumed Winter and Summer gasolines to the disclosed blended gasoline composition prepared using paraffinic naphtha. Renewable fuels such as ethanol and renewable naphtha are considered carbon neutral. Renewable naphtha is obtained as a waste product from the manufacture of renewable diesel and/or renewable jet fuel. Specifically, the biomass (e.g. corn and sugarcane) used in preparation of the renewable fuels absorbs $CO_2$ as it grows. The capture of $CO_2$ during the growth of the biomass may offset the $CO_2$ when the renewable fuel is burned.

The calculations in Tables 4-5 reflect the expected $CO_2$ reduction provided by using the blended gasoline composition in lieu of currently available summer/winter gasolines after subtracting out the renewable carbon derived from the use of ethanol. For this calculation, the remaining non-ethanol hydrocarbons in the fuel blend are considered to be from fossil fuel, i.e. non-renewable hydrocarbons. Table 7 below reflects the formulation of the blended gasoline composition used in the test results of Tables 4-6. Table 8 below provides one example of the hydrocarbon distribution of naphtha suitable for use in the disclosed blended gasoline composition. Of course, a renewable naphtha having the same distribution of hydrocarbons is also suitable for use in the disclosed blended gasoline composition. For the purposes of this disclosure naphtha includes both paraffins and naphthenes having carbon chains from C4 to C12 and traces of C13 and higher as described in Table 8. As discussed above, renewable naphtha is a biproduct of the manufacture of renewable diesel and renewable jet fuel/kerosene. Therefore, when using renewable naphtha, the resulting blended gasoline composition may have nearly a net zero carbon emission contribution for the reasons discussed above.

TABLE 4

| Environmental Improvements provided by the Blended Gasoline Composition Based on U.S. Usage of 150 Billion Gallons of Gasoline Per Year | | | |
|---|---|---|---|
| | Winter Gasoline | Summer Gasoline | Blended Gasoline Composition |
| Summer/ Winter Split | 40% | 60% | |
| USA Gasoline Consumption in gallons/year | 60,000,000,000 | 90,000,000,000 | 156,421,844,955 |
| Total Gasoline usage in pounds/year | 363,508,200,000 | 564,338,970,000 | 916,609,955,957 |
| Total Energy Content in BTU/year | 6,994,624,784,400,000 | 10,466,794,876,590,000 | 17,461,419,660,990,000 |
| Energy Content, in BTU/lb. | 19,242 | 18,547 | 19,050 |
| Pounds of Gasoline used per year | 363,508,200,000 | 564,338,970,000 | 916,609,955,957 |

TABLE 4-continued

Environmental Improvements provided by the Blended Gasoline Composition Based on U.S. Usage of 150 Billion Gallons of Gasoline Per Year

| | Winter Gasoline | Summer Gasoline | Blended Gasoline Composition |
|---|---|---|---|
| Chemical Composition | | | |
| Carbon, wt % | 82.02% | 83.16% | 78.21% |
| Hydrogen, wt % | 14.20% | 13.18% | 15.18% |
| Oxygen, wt % | 3.78% | 3.65% | 5.86% |
| Nitrogen, wt % | | | 0.75% |
| Total Moles Carbon ($CO_2$) | 24,845,133,689 | 39,110,609,092 | 59,740,898,809 |
| Total Moles of Hydrogen | 25,812,823,082 | 37,198,132,031 | 69,549,106,077 |
| Total Moles of Oxygen | 858,809,348 | 1,288,462,302 | 3,358,413,566 |
| Fuel Density as specific gravity | 0.726 | 0.751 | 0.702 |
| Gallons of ethanol used for each gasoline type | 6,000,000,000 | 9,000,000,000 | 23,463,276,743 |
| Ethanol heating value, BTU/gal | 85,430 | 85,430 | 85,430 |
| Total heat content of ethanol | 512,580,000,000,000 | 768,870,000,000,000 | 2,004,467,732,178,730 |
| Density of ethanol as specific gravity | 0.789 | 0.789 | 0.789 |
| Total pounds of ethanol | 39,505,230,000 | 59,257,845,000 | 154,487,024,050 |
| Ethanol, wt % carbon | 52.17% | 52.17% | 52.17% |
| Total moles of carbon from ethanol (CO2) (Renewable Carbon) | 1,717,618,696 | 2,576,428,043 | 6,716,827,133 |
| Gallons of CBOB used in each gasoline type on an annual basis | 54,000,000,000 | 81,000,000,000 | 132,958,568,212 |
| Estimated gallons of reformate required when the blend of gasoline uses 30% (on an annual basis) | 16,200,000,000 | 24,300,000,000 | 0 |
| Estimated gallons of reformer feed at 80% yield required on an annual basis | 20,250,000,000 | 30,375,000,000 | 0 |
| Barrels of reformer feed on an annual basis | 482,142,857 | 723,214,286 | 0 |

TABLE 4-continued

Environmental Improvements provided by the Blended Gasoline Composition Based on U.S. Usage of 150 Billion Gallons of Gasoline Per Year

| | Winter Gasoline | Summer Gasoline | Blended Gasoline Composition |
|---|---|---|---|
| Reformer energy requirement BTU/barrel of feed on an annual basis | 264,000 | 264,000 | 264,000 |
| Total reformer process energy requirement, BTU on an annual basis | 127,285,714,285,714 | 190,928,571,428,571 | 0 |
| Fired heater duty @ 75% efficiency, BTU | 169,714,285,714,286 | 254,571,428,571,429 | 0 |
| Methane heating value, HHV, BTU/lb | 23,811 | 23,811 | 23,811 |
| Methane, lbs | 7,127,558,091 | 10,691,337,137 | 0 |
| Reformer moles of carbon release on an annual basis | 445,472,381 | 668,208,571 | 0 |
| Total moles of carbon with reformer release on an annual basis | 25,290,606,070 | 39,778,817,663 | 59,740,898,809 |
| Net moles of carbon with renewable carbon from ethanol removed on an annual basis | 23,572,987,374 | 37,202,389,619 | 53,024,071,677 |
| Carbon release per unit of energy, (lbs. of carbon/BTU) | 0.0000404 | 0.0000427 | 0.0000364 |
| Annual % carbon reduction due to use of the Blended Gasoline Composition compared to the subject base fuel | 9.90% | 14.56% | |

With reference to Table 4, one can readily recognize that the use of the disclosed blended gasoline composition significantly reduces the release of carbon into the atmosphere. Comparing the carbon release attributed to the Winter Gasoline to that of the blended gasoline composition, the blended gasoline composition reduces carbon dioxide emission by 9.90% on an annual basis. Further, when comparing the Summer Gasoline to that of the blended gasoline composition, the blended gasoline composition reduces carbon dioxide emission by 14.56% on an annual basis. Additionally, the reduced reliance upon use of the catalytic reformer process will further reduce carbon dioxide emission.

The following Table 5 provides further data on carbon and $CO_2$ reductions resulting from the use of the blended gasoline composition. As reflected in Row F of Table 5, use of the blended gasoline composition is expected to reduce $CO_2$ emissions by 12.75% simply due to changing the composition of the gasoline burned. Row I of Table 5 further demonstrates the savings in $CO_2$ emissions due to use of the blended composition and includes the savings in $CO_2$ emissions resulting from reduced dependency on the use of the catalytic reformation process. According to the data provided, the expected overall reduction in U.S. $CO_2$ emissions is 2.68%.

TABLE 5

| Reduction in Carbon Dioxide Emission | | |
|---|---|---|
| A | Total moles of carbon resulting from combustion of winter and summer gasoline on an annual basis | 65,069,423,733 |
| B | Total moles of carbon resulting from combustion of winter and summer gasoline on an annual basis - after deleting renewable carbon attributed to ethanol | 60,775,376,993 |
| C | Estimated total mole of carbon resulting from combustion of the Blended Gasoline Composition | 59,740,898,809 |
| D | Estimated total mole of carbon resulting from combustion of the Blended Gasoline Composition - after deleting renewable carbon attributed to ethanol | 53,024,071,677 |
| E | Net moles of carbon reduction resulting from use of the Blended Gasoline Composition (Row B- Row D) | 7,751,305,317 |
| F | Percent Reduction in $CO_2$ provided from use of the Blended Gasoline Composition (Row E/Row B × 100) | 12.75% |
| G | Reduction in $CO_2$ Emissions measured in Million Metric Tons on an annual basis | 155 |
| H | Per the EPA, the United States 2019 release of $CO_2$ in Million Metric Tons | 5,788 |
| I | Percent Reduction in United States release of $CO_2$ on an annual basis (Row G/Row H × 100) | 2.68% |

Table 6 below provides estimates reflecting the beneficial reduction in refinery operations resulting from use of the disclosed blended gasoline composition. In addition to the previously discussed reduction in operation of the catalytic reformers at refineries, Table 6 demonstrates that use of the blended gasoline composition should also lead to an overall reduction in refinery barrels per day processed. The reduction in refinery processing is a result of the overall lower requirement for the base fuel. Additionally, the use of the disclosed blended gasoline composition simplifies the composition of the base fuel as described in Table 8 below.

TABLE 6

| Estimated Naphtha Required Per Gasoline Type | | | | |
|---|---|---|---|---|
| | | Winter Gasoline | Summer Gasoline | Blended Gasoline Composition |
| A | CBOB gallons/year required for blending each type of gasoline | 54,000,000,000 | 81,000,000,000 | 132,958,568,212 |
| B | Reformer yield Loss per year attributed to refining of each type of gasoline | 4,050,000,000 | 6,075,000,000 | 0 |
| C | Total naphtha for each type of gasoline (gallons) | 58,050,000,000 | 87,075,000,000 | 132,958,568,212 |
| D | Total combined naphtha for summer and winter gasolines | 145,125000,000 | | |
| E | Net reduction in gallons/year of naphtha required resulting from use of the Blended Gasoline Composition as compared to the winter and summer gasolines (Row D - Row C BGC) | | 12,166,431,788 | |
| F | Net reduction in barrels/year of naphtha required resulting from use of the Blended Gasoline Composition as compared to the winter and summer gasolines | | 289,676,947 | |
| G | Net reduction in barrels/day of naphtha required resulting from use of the Blended Gasoline Composition as compared to the winter and summer gasolines | | 827,648 | |
| H | Estimated reduction in barrels per day processed by refineries operating at a 50% naphtha yield for use in the Blended Gasoline Composition | | 413,824 | |
| I | 2019 EPA total refinery crude capacity - million barrels per day | | 18,600,000 | |

TABLE 6-continued

| Estimated Naphtha Required Per Gasoline Type | | | | |
|---|---|---|---|---|
| | | Winter Gasoline | Summer Gasoline | Blended Gasoline Composition |
| J | Crude throughput at 80% of refinery capacity - million barrels per day | | 14,880,000 | |
| K | Estimated percent reduction in barrels per day processed by refineries resulting from use of the Blended Gasoline Composition (Row H/Row J × 100) | | 2.78% | |

TABLE 7

| Example Composition of the Blended Gasoline Composition | |
|---|---|
| Blended Gasoline Composition | Vol % |
| Naphtha | 81 |
| Ethanol | 15 |
| m-toluidine | 4 |
| Total | 100 |

TABLE 8

| Naphtha Hydrocarbon Distribution (Volume Percent) | |
|---|---|
| C4 | 0-10% |
| C5-C6 | 25-40% |
| C7-C8 | 30-50% |
| C9-C10 | 3-30% |
| C11-C12 | 0-25% |
| C13 and higher | 0-5% |

With continued reference to Tables 4-5, the resulting carbon released into the atmosphere due to motor vehicle use of summer and winter current blends of gasoline is over 60 billion moles. This total includes carbon release due to operation of catalytic reformers in the refineries. In contrast, the blended gasoline composition disclosed herein does not rely upon products prepared by the catalytic reformers, e.g. aromatic hydrocarbons. As discussed above, with the exception of the aromatic amine octane booster compounds, the blended gasoline composition contains minimal concentrations of aromatic compounds. Thus, use of reformate from the catalytic reformer can be eliminated such that the aromatic compounds in the blended gasoline composition result primarily from naturally occurring aromatics in the crude oil. More directly, Table 9 shows the expected Carbon Release per Unit of Energy in pounds of Carbon per BTU upon burning of the respective gasoline compositions in an internal combustion engine.

TABLE 9

| Expected Carbon Release per Unit of Energy - pound/BTU | |
|---|---|
| Current Summer Gasoline | 0.0000427 pound/BTU |
| Current Winter Gasoline | 0.0000404 pound/BTU |
| Blended Gasoline Composition | 0.00004 or less pound/BTU |

Using data found in Table 4, the carbon release per unit of energy for the blended gasoline composition may be as low as 0.0000364 pound per BTU when the blended gasoline composition is burned in an internal combustion engine. See Table 4, the row titled "Carbon release per unit of energy, (lbs. of carbon/BTU)."

Thus, eliminating the need for catalytic reformation in the refining process further reduces the release of carbon dioxide to the atmosphere. The catalytic reforming process typically results in a 20% yield loss on feed. By minimizing the need for use of the catalytic reforming process in the refining and production of gasoline, refinery crude rates will decrease an estimated 3% for the same gasoline production. Likewise, $CO_2$ reductions will be significant for the entire manufacturing chain of crude oil production, transportation, storage, and refining as less crude oil is required to be processed into gasoline.

In total, the blended gasoline composition disclosed herein provides for approximately 12% less carbon dioxide ($CO_2$) emissions than currently available gasoline formulations. The 12% reduction in carbon dioxide emission provides a reduction of approximately 155 million metric tons of carbon dioxide. As an additional benefit, the substantial reduction and/or elimination of aromatic hydrocarbons from gasoline reduces consumer exposure to known carcinogenic compounds.

Other embodiments of the present invention will be apparent to one skilled in the art. As such, the foregoing description merely enables and describes the general uses and methods of the present invention. Accordingly, the following claims define the true scope of the present invention.

What is claimed is:

1. A blended gasoline composition comprising:

an aromatic amine in concentrations ranging from about 0.1% to about 5% by volume;

ethanol in concentrations between about 10% and about 20%;

non-amine aromatic hydrocarbons in concentrations up to about 15%;

olefins in concentrations up to about 8%;

paraffins in concentrations up to about 90%.

2. The blended gasoline composition of claim 1, wherein one pound of said blended gasoline composition produces 0.00004 pound of carbon per BTU or less when combusted in an internal combustion engine.

3. The blended gasoline composition of claim 1, wherein said blended gasoline composition has an anti-knock index value of at least 87.

4. The blended gasoline composition of claim 1, wherein said olefin concentration is about 5.00% or less.

5. The blended gasoline composition of claim 1, wherein said olefin concentration is about 3.00% or less.

6. The blended gasoline composition of claim 1, wherein said olefin concentration is about 1.00% or less.

7. The blended gasoline composition of claim 1, wherein said olefin concentration is 0.00%.

8. The blended gasoline composition of claim 1, wherein said aromatic concentration is about 10% or less.

9. The blended gasoline composition of claim 1, wherein said aromatic concentration is about 5% or less.

10. The blended gasoline composition of claim 1, wherein said aromatic concentration is less than about 1%.

11. The blended gasoline composition of claim 1, wherein said ethanol is present in concentrations between about 10% and about 15%.

12. The blended gasoline composition of claim 1, wherein said blended gasoline composition has a paraffin, olefin, naphthene and aromatic distribution by volume comprising:

from about 70% to about 90% paraffin;
from about 0% to about 8% olefins;
from about 0% to about 10% naphthenes; and,
from about 0% to about 15% aromatics.

13. The blended gasoline composition of claim 1, wherein said blended gasoline composition has hydrocarbons with a carbon chain length distribution comprising:

hydrocarbons having four carbon atoms from about 0% to about 10% by volume;
hydrocarbons having five carbon atoms and hydrocarbons having six carbon atoms from about 25% to about 40% by volume;
hydrocarbons having seven carbon atoms and hydrocarbons having eight carbon atoms from about 30% to about 50% by volume;
hydrocarbons having nine carbon atoms and hydrocarbons having ten carbon atoms from about 3% to about 30% by volume;
hydrocarbons having eleven carbon atoms and hydrocarbons having twelve carbon atoms from about 0% to about 25% by volume; and,
hydrocarbons having at least thirteen carbon atoms from about 0% to about 5% by volume.

14. The blended gasoline composition of claim 1, wherein said aromatic amine is selected from the group consisting of m-toluidine, p-toluidine, o-toluidine and aniline as well as mixtures of the identified compounds.

15. The blended gasoline composition of claim 14, wherein said aromatic amine is m-toluidine and said m-toluidine is present in an amount of about 4% by volume of said blended gasoline composition.

16. The blended gasoline composition of claim 1, wherein said ethanol has a blended octane value of at least 130.

17. The blended gasoline composition of claim 1, wherein said ethanol has a blended octane value of at least 135.

18. The blended gasoline composition of claim 14, wherein said aromatic amine is m-toluidine and m-toluidine has a blended octane value of at least 300.

19. The blended gasoline composition of claim 14, wherein said aromatic amine is m-toluidine and said m-toluidine has a blended octane value of at least 500.

20. A blended gasoline composition comprising:

an aromatic amine in concentrations ranging from about 0.1% to about 5% by volume;
ethanol in concentrations between about 10% and about 20%;
non-amine aromatic hydrocarbons in concentrations up to about 5%;
olefins in concentrations up to about 4%;
paraffins in concentrations up to about 86%.

21. The blended gasoline composition of claim 20, wherein said blended gasoline composition is substantially free of olefins.

22. The blended gasoline composition of claim 20, wherein said blended gasoline composition is substantially free of non-amine aromatic compounds.

23. The blended gasoline composition of claim 20, wherein said blended gasoline composition has a paraffin, olefin, naphthene and aromatic distribution by volume comprising:

from about 70% to about 90% paraffin;
from about 0% to about 8% olefins;
from about 0% to about 10% naphthenes; and,
from about 0% to about 15% aromatics.

24. The blended gasoline composition of claim 20, wherein said blended gasoline composition has hydrocarbons with a carbon chain length distribution comprising:

hydrocarbons having four carbon atoms from about 0% to about 10% by volume;
hydrocarbons having five carbon atoms and hydrocarbons having six carbon atoms from about 25% to about 40% by volume;
hydrocarbons having seven carbon atoms and hydrocarbons having eight carbon atoms from about 30% to about 50% by volume;
hydrocarbons having nine carbon atoms and hydrocarbons having ten carbon atoms from about 3% to about 30% by volume;
hydrocarbons having eleven carbon atoms and hydrocarbons having twelve carbon atoms from about 0% to about 25% by volume; and,
hydrocarbons having at least thirteen carbon atoms from about 0% to about 5% by volume.

25. The blended gasoline composition of claim 20, wherein said aromatic amine is selected from the group consisting of m-toluidine, p-toluidine, o-toluidine and aniline as well as mixtures of the identified compounds.

26. The blended gasoline composition of claim 21, wherein said aromatic amine is m-toluidine and said m-toluidine is present in an amount of about 4% by volume of said blended gasoline composition.

27. The blended gasoline composition of claim 20, wherein one pound of said blended gasoline composition produces 0.00004 pound of carbon per BTU or less when combusted in an internal combustion engine.

28. The blended gasoline composition of claim 20, wherein said ethanol has a blended octane value of at least 130.

29. The blended gasoline composition of claim 20, wherein said ethanol has a blended octane value of at least 135.

30. The blended gasoline composition of claim 25, wherein said aromatic amine is m-toluidine and m-toluidine has a blended octane value of at least 300.

31. The blended gasoline composition of claim 25, wherein said aromatic amine is m-toluidine and said m-toluidine has a blended octane value of at least 500.

32. A blended gasoline composition comprising:

an aromatic amine selected from the group consisting of m-toluidine, p-toluidine, o-toluidine and aniline as well as mixtures of the identified compounds in concentrations ranging from about 0.1% to about 5% by volume;
ethanol in concentrations between about 10% and about 20%;
paraffins in concentrations up to about 86%; and, wherein said blended gasoline composition is substantially free of non-amine aromatic compounds.

33. The blended gasoline composition of claim 32, wherein said blended gasoline composition is substantially free of olefins.

34. The blended gasoline composition of claim 32, wherein said blended gasoline composition has a paraffin, olefin, naphthene and aromatic distribution by volume comprising:

from about 70% to about 90% paraffin;

from about 0% to about 8% olefins;

from about 0% to about 10% naphthenes; and, from about 0% to about 15% aromatics.

35. The blended gasoline composition of claim 32, wherein said blended gasoline composition has hydrocarbons with a carbon chain length distribution comprising:

hydrocarbons having four carbon atoms from about 0% to about 10% by volume;

hydrocarbons having five carbon atoms and hydrocarbons having six carbon atoms from about 25% to about 40% by volume;

hydrocarbons having seven carbon atoms and hydrocarbons having eight carbon atoms from about 30% to about 50% by volume;

hydrocarbons having nine carbon atoms and hydrocarbons having ten carbon atoms from about 3% to about 30% by volume;

hydrocarbons having eleven carbon atoms and hydrocarbons having twelve carbon atoms from about 0% to about 25% by volume; and, hydrocarbons having at least thirteen carbon atoms from about 0% to about 5% by volume.

36. The blended gasoline composition of claim 32, wherein said aromatic amine is m-toluidine and said m-toluidine is present in an amount of about 4% by volume of said blended gasoline composition.

37. The blended gasoline composition of claim 32, wherein one pound of said blended gasoline composition produces 0.00004 pound of carbon per BTU or less when combusted in an internal combustion engine.

38. The blended gasoline composition of claim 32, wherein said ethanol has a blended octane value of at least 130.

39. The blended gasoline composition of claim 32, wherein said ethanol has a blended octane value of at least 135.

40. The blended gasoline composition of claim 32, wherein said aromatic amine is m-toluidine and m-toluidine has a blended octane value of at least 300.

41. The blended gasoline composition of claim 32, wherein said aromatic amine is m-toluidine and said m-toluidine has a blended octane value of at least 500.

* * * * *